United States Patent [19]

Jundt et al.

[11] 4,176,645

[45] Dec. 4, 1979

[54] MOTOR IGNITION SYSTEM CONTROL CIRCUIT FOR MAINTAINING ENERGY STORAGE IN SPARK COIL CONSTANT IN WIDE SPEED RANGE

[75] Inventors: Werner Jundt, Ludwigsburg; Gerhard Söhner, Remshalden; Peter Werner, Stuttgart; Herman Roozenbeek, Schwieberdingen, all of Fed. Rep. of Germany

[73] Assignee: Robert Bosch GmbH, Stuttgart, Fed. Rep. of Germany

[21] Appl. No.: 734,745

[22] Filed: Oct. 22, 1976

[30] Foreign Application Priority Data

Nov. 5, 1975 [DE] Fed. Rep. of Germany ..... 2549586

[51] Int. Cl.[2] ..... F02P 1/00

[52] U.S. Cl. ..... 123/148 E

[58] Field of Search ..... 123/148 E; 315/209 T

[56] References Cited

U.S. PATENT DOCUMENTS

| | | | |
|---|---|---|---|
| 3,238,416 | 3/1966 | Huntzinger et al. | 315/209 T |
| 3,605,713 | 9/1971 | LeMasters et al. | 123/148 E |
| 3,838,672 | 10/1974 | Richards et al. | 123/148 E |

FOREIGN PATENT DOCUMENTS 1539178 3/1970 Fed. Rep. of Germany .

*Primary Examiner*—Charles T. Jordan

*Attorney, Agent, or Firm*—Frishauf, Holtz, Goodman & Woodward

[57] ABSTRACT

A monitoring resistor in series with the spark coil primary winding and the electronic interruptor switch provides a signal to an integrator for shifting the control thresholds of a threshold switch that controls the interruptor away from their quiescent values that are nearer the zero crossover of the timing voltage wave provided by an engine driven timing signal generator. The integrator output voltage remains constant during the time the interruptor switch is open. While current flows through the interruptor circuit, the integrator increases the control voltage until the primary winding current reaches a predetermined level and then decreases the control voltage until the timing wave recloses the interruptor. While the control voltage is being decreased, the coil current is allowed to rise to a limiting value and is then held constant by another circuit controlled by the monitoring resistor that slightly reduces the conductivity of the interruptor switch in its closed condition, but this occurs only while the engine is accelerating to the operating speed range. During this time the switch-on threshold for controlling the interruptor is raised towards the peak of the timing wave, but the switch-off threshold is clamped to its initial value. With further increase in engine speed, the net effect of the integrator operation changes sign and the switch-on threshold is lowered. As soon as the switch-on threshold goes below its initial value, the switch-off threshold is unclamped and is depressed along with the switch-on threshold towards the negative peak of the timing wave by the integrator action. The result is to keep the amount of energy stored in the spark coil at the time of primary circuit interruption constant over a wide range of speed.

28 Claims, 2 Drawing Figures

MOTOR IGNITION SYSTEM CONTROL CIRCUIT FOR MAINTAINING ENERGY STORAGE IN SPARK COIL CONSTANT IN WIDE SPEED RANGE

This invention concerns an ignition system for an internal combustion engine, particularly for a motor vehicle engine equipped with a direct current supply, the ignition system being of a kind in which an electronic interruptor is interposed in the circuit of the primary winding of a spark coil between the primary winding and one pole of the direct current source, the interruptor being under control of a threshold switch to cause a current to flow through the primary winding for a duration determined by a control signal, after which the current is suddenly interrupted to cause a high voltage pulse to be provided by the secondary winding of the spark coil to a spark plug. The threshold switch that controls the interruptor switch responds to a control signal that is furnished by an engine driven generator of a suitable alternating voltage wave.

In operation of an ignition system of the type just identified it is desired that even at high engine speed a sufficient ignition energy quantity should be made available in the spark coil for each firing and that at low engine speed current should flow through the primary winding only long enough in each firing cycle to produce an effective ignition spark.

As disclosed in German published patent application (OS) No. 1 539 178, an ignition system of the above defined kind is known in which the current flow and current interruption in the primary winding is controlled by the provision of an engine driven voltage wave generator that produces an alternating voltage wave of particular wave shape so that with increasing engine speed the portion of the time between two firings in which current flows through the primary winding increases, whereas the proportion of this time span during which the current is interrupted decreases. This ignition system, however, requires for the generation of such an alternating voltage wave a generator in which the geometrical form of the rotor must be determined empirically by trial and error and as a rule fails so often in production tests that it is difficult and expensive to produce in quantity. Furthermore, in this case a constancy of the duration of the current flow per firing cycle in the primary winding cannot be obtained.

It is an object of the present invention to provide an ignition system of the kind above defined in which the deficiencies of the known embodiments are overcome.

SUMMARY OF THE INVENTION

Briefly, in response to the amount of current flow through the primary winding and the electronic interruptor a control voltage is produced for shifting the threshold of the threshold switch. In the quiescent state the thresholds of the threshold switch are near the zero crossover voltage of the timing signal generator, which is to say that they are just above a reference voltage, preferably about half the output voltage of the vehicle battery, which is supplied to one terminal of the timing signal generator and to one terminal of the input network of the threshold switch. When the duration of current flow in the spark coil primary tends to be too great, the control voltage shifts the switch-on threshold of the threshold switch towards the peak value of the timing signal generator output, meaning in this case the peak which is of the same polarity as the ungrounded terminal of the vehicle battery, and when the duration of current in the primary of the spark coil in a firing cycle tends to be too short, the control voltage shifts the thresholds of the threshold switch in the other direction and can do so even below the d.c. reference voltage, within the peak to peak limits of the timing signal generator wave form.

The control voltage in the preferred form of the invention is developed by means of an integrator responsive to a voltage across a monitoring resistor in series with the interruptor switch and the primary winding. The integrator is caused to build up a control voltage in one direction until the current in the primary reaches a predetermined value which is short of the value needed to develop the necessary ignition spark energy upon interruption and thereafter the integrator is arranged to develop its output voltage in the opposite direction. The operation of the integrator begins when the interruptor turns on the current in the primary of the spark coil and ceases when the interruptor turns off that current. The control voltage developed by the integrator remains substantially constant during the periods of no current through the interruptor, so that the switch-on and control of the interruptor is affected by the control voltage remaining after the integrator operation in the previous firing cycle.

In particular development of the invention the threshold switch is coupled to the interruptor switch through a circuit that limits the spark coil primary current when a certain desired value is reached.

In the ignition system of the invention operation is not limited to the capabilities available by the use of a timing voltage wave of a particular wave shape and, regardless of the particular wave shape chosen, it is possible to obtain a substantially constant duration per firing cycle of the current flow in the primary winding of the spark coil.

The invention is further described by way of illustrative example with reference to the accompanying drawings, in which:

FIG. 1 is a circuit diagram of an ignition system embodying the present invention, and FIG. 2 is a timing diagram showing on parallel time axes a, b, c and d the wave forms of voltages at different places in the circuit of FIG. 1, with the instants of significance being indicated by vertical dash-dot lines, most of which are drawn across the entire figure.

DESCRIPTION OF THE PREFERRED EMBODIMENT

Figure 1:
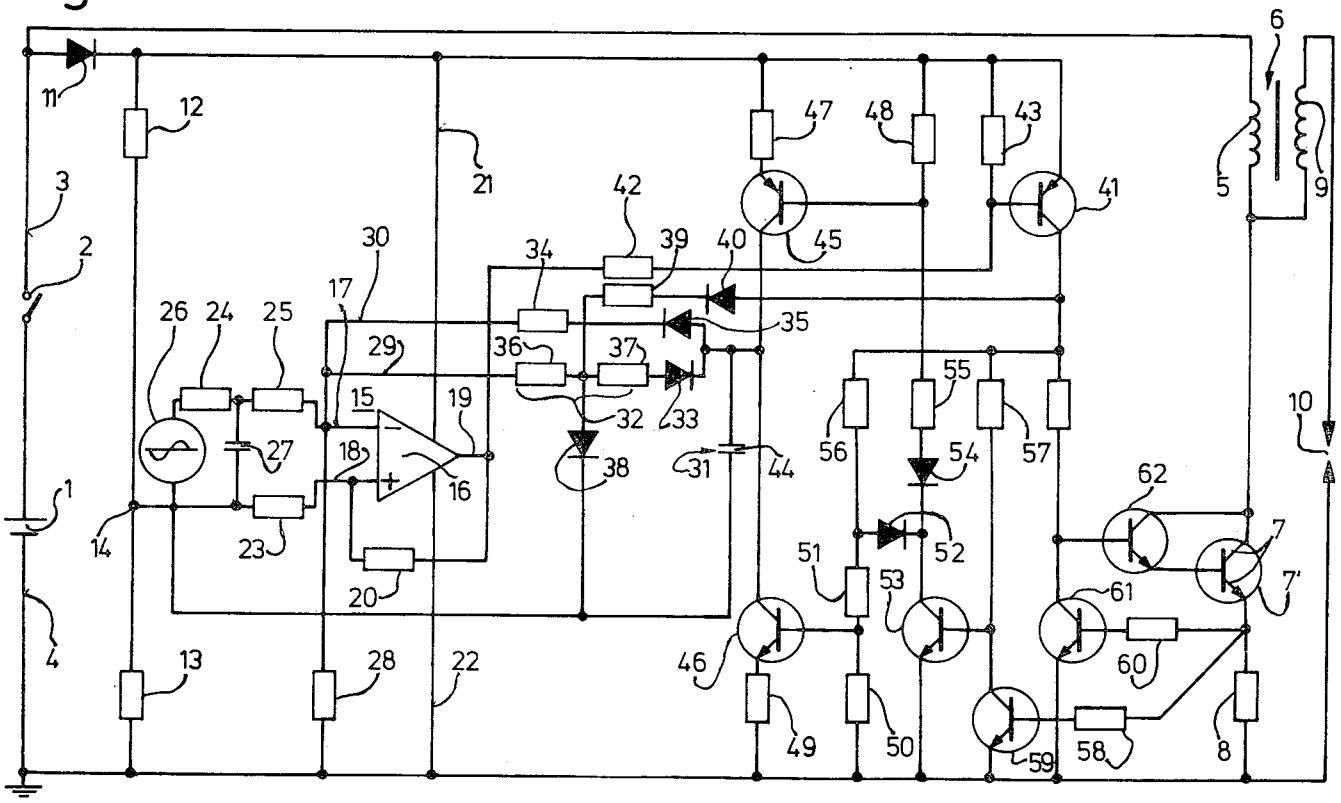

The circuit diagram of FIG. 1 represents the ignition system of an internal combustion engine, not shown in the drawing, that is installed in a motor vehicle likewise not shown. The ignition system is fed from a direct current source 1 that can be the storage battery of the motor vehicle. The positive terminal of the battery is connected to the ignition switch 2 of the vehicle, though which it is connected to the positive voltage supply lead 3. The negative terminal of the battery is connected to the negative voltage lead of the ignition system 4 which is grounded to the vehicle chassis and engine structure as shown by the usual symbol at the lower left of the diagram. The positive voltage lead 3 is connected to a terminal of the primary winding 5 of a spark coil 6, through which primary winding it is connected then to an electronic interruptor switch 7, from which the circuit is completed over a monitoring resistor 8 to the negative voltage line 4.

The electronic interruptor switch 7 in the illustrated preferred embodiment is constituted by the emitter-collector path of a transistor 7'. The terminal of the primary winding 5 that is connected to the transistor 7' is connected to one end of the secondary winding 9 of the spark coil 6 and the other end of that secondary winding is connected to a spark plug 10 which completes the secondary circuit on the grounded side of its spark gap. Of course, the secondary winding 9 could be arranged to fire more than one spark plug by the provision of a spark distributor of the usual kind for distributing the ignition energy in a predetermined firing cycle to a number of spark plugs in the usual way.

The positive voltage supply line 3 provides positive voltage for the control portion of the ignition circuit through a diode 11 that is provided in the control circuit to protect the circuit against connection to the wrong polarity of supply voltage. When the ignition switch 2 is turned on, the battery supplies current through the diode 11, which is connected in its conducting direction, to a voltage divider composed of resistors 12 and 13 connected in series between the diode 11 and the negative voltage line. The connection between the resistors 12 and 13 is identified as the control circuit point 14 and this point has a potential of about half the voltage of the direct current source 1.

The ignition control circuit shown has a threshold switch 15 that in the illustrated preferred embodiment is constituted by an operational amplifier 16 that has an inverting input 17, a noninverting input 18 and an output 19 at which it provides a control voltage for following stages of the system. Positive feedback is provided by a resistor 20 connected between the output 19 and the noninverting input 18 so that the switch will change over quickly from one stable output voltage to another as the input voltage condition crosses a switching threshold.

Two proportioning resistors 24 and 25 are connected in series, with one end of the series combination being connected to the inverting input 17 of the operational amplifier 16 and the other end to a terminal of the timing voltage wave generator 26 that is driven by the vehicle engine, the other terminal of that generator being connected to the control circuit point 14 previously mentioned. The common connection of the series resistors 24 and 25 is connected to a capacitor 27, the other terminal of which is connected to the control circuit point 14 so as to protect the threshold switch 15 against pulses from extraneous electrical disturbances. The timing voltage wave generator 26 in the preferred case will operate as an alternating current generator and provide an alternating voltage with an output wave of the form illustrated on line a of FIG. 2 where output voltage U is plotted against time t.

The inverting input 17 is also connected over a resistor 28 to the negative voltage line 4 and, furthermore, over two parallel control lines 29 and 30 respectively operating for different control polarities determined by the diodes 33 and 35 respectively, to an integrator generically designated 31, in this case constituted simply by the capacitor 44. The integrator output voltage is a control voltage for shifting the switch-on threshold U2 (FIG. 2 line a) of the threshold switch 15. The first control lead 29 connects the inverting input 17 of the operational amplifier 16 to a series combination of a resistor combination 32 and a diode 33 that has its cathode connected to the integrator 31, while the second control lead 30 connects the inverting input 17 of the operational amplifier 16 through the series combination of a resistor 34 and a diode 35 that has its anode connected to the integrator 31. The resistor combination 32 is made up of two resistor components 36 and 37 with their intermediate connection connected to the anode of a diode 38, of which the cathode is connected back to the control circuit point 14. The common connection of the resistor components 36 and 37 is also connected through a resistor 39 and another diode 40 to the collector of the driver transistor 41. The diode is so poled that it conducts when the transistor 41 is fully conducting. The transistor 41 is a driver or feed transistor for the input circuit of the interruptor switch 7. Accordingly, the base of the transistor 41 is connected over a resistor 42 to the output connection 19 of the operational amplifier 16 and is also connected over a resistor 43 to its own emitter, which is connected to the positive voltage supply on the cathode side of the protective diode 11.

Although the integrator 31 is illustrated in FIG. 1 as the simplest case in which it is constituted by a capacitor 44 which has one side connected to the circuit point 14 and the other connected through resistors and differently poled diodes to the control leads 29 and 30 respectively, the integrator 31 could also be constituted with a capacitor like the capacitor 44 operating in a well known form of connection with an operational amplifier.

The terminal of the integrator 31 which is not connected to the circuit point 14, in addition to being connected to the diodes 33 and 35 which feed its output control circuits, is connected to the collector of a first control transistor 45 and to the collector of a second control transistor 46, these transistors being of complementary types, in this case the control transistor 45 being a pnp transistor and transistor 46 being an npn transistor. The emitter of the first control transistor 45 is connected over a resistor 47 to the positive line coming from the cathode of the diode 11 and the base of this same transistor is likewise connected to that positive line over a resistor 48, so that a constant current flows through the emitter-collector path of this transistor 45, so that the circuit of this transistor operates as a constant current source. The second control transistor 46 has its emitter connected over a resistor 49 to the negative voltage supply line 4 and, likewise, its base connected to that same negative voltage supply line over a resistor 50, so that a constant current also flows through the emitter-collector path of this transistor 46 and its circuit also operates as a constant current source. The base of the second control transistor 46 is connected over a resistor 51 to the anode of a blocking diode 52, of which the cathode is connected both to the collector of an npn intermediate transistor 53 and to the cathode of another blocking diode 54, the anode of which is connected over a resistor 55 to the base of the first control transistor 45. The anode of the blocking diode 52 is also connected over a resistor 56 both to the collector of the driving transistor 41 and to one end of a resistor 57 of which the other end is connected to the base of the intermediate transistor 53.

From the ungrounded end of the monitoring resistor 8, a branch circuit leads over a resistor 58 to the base of an npn monitoring transistor 59 and is completed to the emitter of the transistor 59 which is grounded to the negative voltage lead 4. The collector of the monitoring transistor 59, which reproduces the feedback voltage to which the control circuit is responsive, is connected to the base of the intermediate transistor 53. There is still another branch circuit from the ungrounded end of the monitoring resistor 8, which leads over a resistor 60 to the base of a supplementary transistor 61 of npn type and is completed through the emitter of this transistor which is grounded to the negative voltage lead 4. The collector of the supplementary transistor 61 is connected to the base of an additional transistor 62 of npn type that has its emitter-collector path in shunt with the base-collector path of the transistor 7', so that it forms a Darlington circuit with the transistor 7'. The base of the transistor 62, which is the input of the Darlington circuit, is connected to the collector of the driver transistor 41, which as will be seen when the operation of the circuit is described, could also be called a coupling transistor. The timing signal from the timing wave generator which produces the voltage wave that switches over the threshold switch 15, at whatever level its thresholds may at the time be set, produces a wave that swings positive and negative with respect to the potential provided at the control circuit point 14, a wave which has at least one portion that rises to a positive peak value U1 (line a of FIG. 2) and then falls back again, the peak value U1 being reached only after a certain potential rise time and not by a sudden voltage step. Thus, there is provided in the illustrated case at least one positive halfwave W1 of the alternating voltage wave output of the timing signal generator 26, with reference to the potential of the control circuit point 14, which voltage halfwave operates as the timing signal proper. With the input shunt resistor 28 to the ground side of the circuit, the operation of the threshold switch 15 is so fixed that when the engine is started, the threshold switch 15 will be both switched on and switched off by the positive halfwave W1. Thus, as shown in line a of FIG. 2, under starting conditions of the engine, which may be referred to as the quiescent state condition for short, the switch-on threshold U2 and the switch-off threshold U3 of the threshold switch 15 lie barely above the zero crossover value of the output wave of the timing signal generator 26. The above-described relations have the advantage that if the ignition switch is closed while the engine is not running, the emitter-collector path of the transistor 7' is safely kept in the non-conducting condition, so that in such a case no current can flow through the primary winding 5. If such a current did flow, it would cause undesirable heating up of the spark coil 6.

Figure 2:
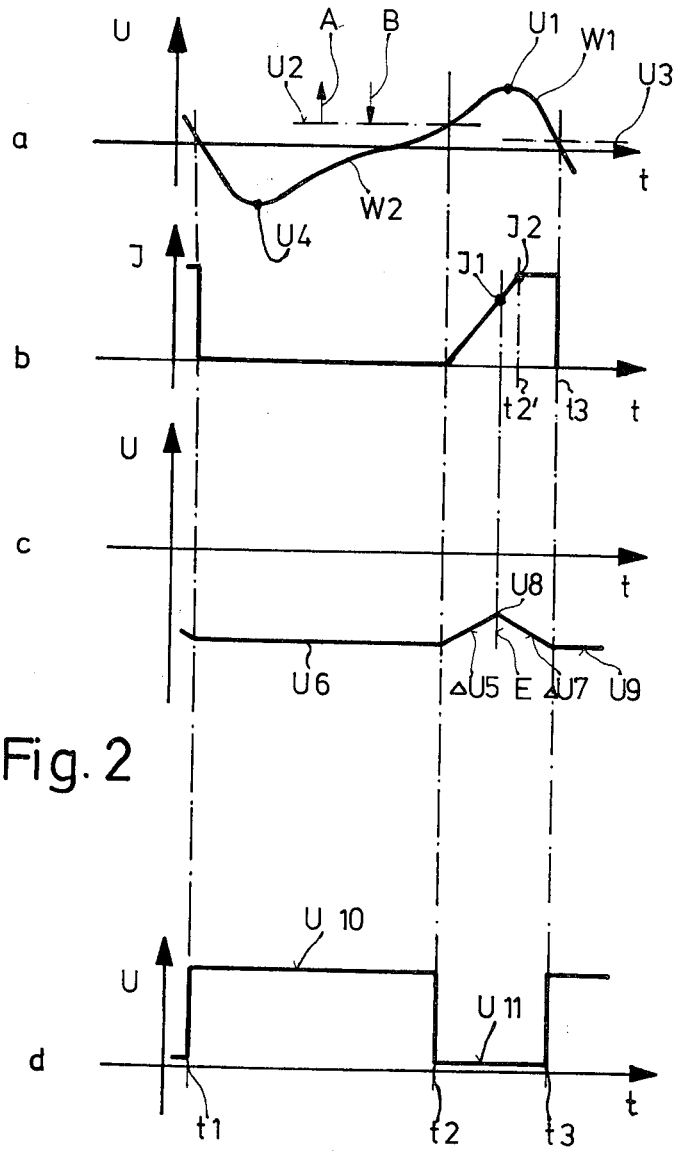

The shift of the switching threshold U2 is so influenced by the circuit that during run-up of the engine into the operating speed range, the switching threshold U2 wanders towards the peak value U1 of the positive halfwave W1, which is to say it is shifted in the direction designated by the arrow A in FIG. 2 and, when the engine speed rises further in the operating speed range, it goes back in the opposite direction, designated by the arrow B in FIG. 2, away from the peak value U1. Thereafter, the switching threshold U2 can go so far from the peak value U1 of the positive halfwave W1 as to reach at least to the neighborhood of the peak value U4 of the negative halfwave W2 provided by the timing wave generator 26.

The switch-off threshold U3 is kept fixed in its position so long as the speed of the engine rises and the switch-on threshold U2 has not yet gone back to its initial position as it is moved away by the control voltage from the timing wave peak value U1. As soon as the switch-on threshold U2 gets back to its initial position, then any further increase of the engine speed shifts the switch-off threshold U3 along with the switch-on threshold U2 in the direction B and actually shifts the former in that direction somewhat ahead of the switch-on threshold U2.

The displacement of the switch-on threshold U2 is accomplished in the manner indicated by the voltage-time diagram drawn on line c of FIG. 2. As there shown, as soon as the threshold switch 15 switches on, at the moment t2, the integrator 31 begins to produce a threshold change ΔU5 to the initial integration output value U6 that existed during the interval t1−t2 preceding the operation of the threshold switch 15. The end of the first voltage change ΔU5 and the beginning of the immediately following second voltage change ΔU7, occurring at the peak integration value U8 is made dependent upon the rise of current flow in the primary winding 5 to a predetermined control value J1, that is indicated on line b of FIG. 2 where the primary current J is plotted against the time t. The end of the second control voltage change ΔU7 is determined by the switching off of the threshold switch 15. The integration output value U9 existing at that switch-off moment remains substantially conserved during the following interval until another change of the first kind begins. The first change ΔU5 and the second change ΔU7 are so set that when the engine speed remains the same, they are symmetrical with respect to a vertical line E on the timing diagram through the peak integrator output value U8, with the changeover from the first change ΔU5 to the second change ΔU7 is chosen to take place at the empirical control value of primary current J1. That current value is not the actually desired final primary coil current. The current in the primary winding 5 is allowed to rise further to a desired final value J2 at which sufficient energy is stored in the spark coil 6 to produce a fully effective ignition spark.

In the illustrated case the voltage changes ΔU5 and ΔU7 are produced by currents of the same strength. Of course, one of these currents could be made to be stronger than the other, in which case its period of flow would be made shorter than that of the other.

In the preferred embodiment, the first change ΔU5 is an increase of the integrator output voltage and the second change ΔU7 is a decrease of the integrator output voltage (i.e. of the charge across the capacitor 44).

It should be further mentioned that, as shown in the voltage-time diagram on line d of FIG. 2, the potential U10 at the output of the threshold switch 15 in the switched-off condition of the latter, which is to say the voltage there during the time period t1−t2, should be at or at least very close to the potential of the positive voltage supply line 3 and the potential U11 at the output 19 in the switched-on condition of the threshold switch, which is to say the potential there during the period t2−t3, should be at or at least very close to the potential of the negative voltage supply line 4, which is the supply line grounded to the chassis in the diagram.

OPERATION OF THE ABOVE-DESCRIBED IGNITION SYSTEM

When the ignition switch 2 is closed and the engine is started and the timing signal from the signal generator 26 next rises above the switch-on threshold U2 of the threshold switch 15, the potential U11 appears at the output connection 19 of the threshold switch which, as already mentioned, is substantially at the potential of the negative voltage supply line 4. Control current then begins to flow through the base-emitter path of driver transistor 41 causing the emitter-collector path of this transistor to be conducting. In consequence, the base-emitter path of the input transistor 62 of the Darlington circuit receives current and also the base-emitter path of the switching transistor 7', so that its emitter-collector path likewise becomes conducting and current begins to flow through the primary winding 5.

As already explained, in the quiescent or starting condition the threshold U2 lies barely above the zero axis of the voltage wave produced by the timing signal generator, which is to say, barely above the potential of the circuit point 14, so that it is assured that even if the voltage wave of the timing signal generator has a relatively low peak value when the engine first starts up, the threshold switch 15 will nevertheless be switched on.

When the driver transistor 41 conducts, the base-emitter path of the intermediate transistor 53 will also receive current, so that its emitter-collector path will conduct and provide base-emitter current for the first control transistor 45, so that the emitter-collector path of the transistor 45 will also be conducting. In consequence, the integrator 31, which has up to now had the output voltage U6, now begins to make the voltage change ΔU5 at its output, until the flow of current in the primary winding 5 builds up to the control value J1. When that happens, the voltage drop across the monitoring resistor 8 reaches a value at which the emitter-collector path of the monitoring transistor 59 is caused to become conducting. When that happens, the base-emitter path of the intermediate transistor 53 is short-circuited and accordingly the corresponding emitter-collector path is blocked, and likewise the emitter-collector path of the first control transistor 45. Then current will be supplied from the emitter-collector path of driver transistor 41 to the base-emitter path of the second control transistor 46 and the now conducting emitter-collector path of the latter transistor will produce the second change ΔU7 of the control voltage, which begins with the integration output value U8 which was reached when the above-described events took place as a consequence of the current in the primary winding having reached the value J1.

The second change ΔU7 of the control voltage ends as soon as the voltage wave of the timing signal generator 26 drops down below the switch-off threshold U3 of the threshold switch 15. When that happens, the potential U10 appears at the output of the threshold switch 15, which potential, as already mentioned, lies close to the potential of the positive voltage supply line 3. Then no more control current can flow through the base-emitter path of the driver transistor 41, and the emitter-collector path of that transistor accordingly becomes non-conducting. The control current in the base-emitter path of the second control transistor 46 therefore also vanishes, the emitter-collector path of the latter transistor then becoming non-conducting and causing the end of the second change ΔU7 of the output of the integrator 31. When the driver transistor 41 switches over into the non-conducting condition, the emitter-collector path of the transistor 7' likewise becomes non-conducting, interrupting the flow of current in the primary winding 5 and producing a high voltage pulse in the secondary winding 9 that produces an ignition spark in the sparkplug 10.

The supplementary transistor 61 assures that the current in the primary winding 5, after having reached a desired value J2 which is sufficient for a fully effective ignition spark, will not increase any further. After the desired value J2 of primary winding current has been reached, the emitter-collector path of the supplementary transistor 61 is made somewhat conducting by the voltage drop across the monitoring resistor 8 and in consequence the conductivity of the emitter-collector path of the transistor 7' is somewhat reduced, just enough to keep the current flow at the desired value J2. It is desirable for the circuit to be so designed that during starting of the engine, the current in the primary winding 5, after reaching the desired value J2, will continue to flow at this same strength for a further time period t2' - t3, so that during the acceleration of the vehicle driven by the engine sufficient energy for ignition will still be stored in the primary winding 5 in spite of the shortening of the period of the flow of current.

During run-up of the engine after start-up, the second change ΔU7 of the integrator output lasts longer than the first change ΔU5, so that the integration value U9 after the second change ΔU7 is in each cycle more negative than the integration value U6 before the beginning of the first change ΔU5. This affects the inverting input 17 of the switch 15 over the first control lead 29, so that the switch-on threshold U2 of the threshold switch 15 wanders in the positive direction indicated by the arrow A in FIG. 2. If the engine speed rises still further, however, the second change ΔU7 of the output of the integrator 31 will last for a shorter period than the first change ΔU5, so that the integration result U9 after the second change ΔU7 will be more positive than the initial integration value U6 before the first change ΔU5. This operates over the first control lead 29 of the inverting input 17 of the switch 15 and—after the integration value U9 becomes positive relative to the control circuit point 14—so that the switching threshold U2 will now wander in the negative direction indicated by the arrow B in FIG. 2. The coupling of the integrator to the threshold switch through the lead 29 operates through a path of lower ohmic resistance than the coupling through the second control lead 30 to the inverting input 17 of the threshold switch.

When the engine is started, the primary winding 5 is at once provided with current for the time necessary to provide energy for a fully effective ignition spark and by the operation of the supplementary transistor 61, the switching transistor 7' is temporarily operated in its active region, which is to say that there is some dissipation in the circuit of the spark coil primary, but that happens in a speed range through which the engine passes only in starting up and the engine runs through that range relatively fast. The advantage is obtained, on the other hand, that during the operation of the engine in the speed range in which the switch-on threshold U2 of the threshold switch 15 moves away from the region of the peak value U1 of the positive halfwave W1 into the neighborhood of the opposite peak value U4 of the negative halfwave W2, a sufficiently constant amount of energy is stored in the start coil 6 in every cycle up to a relatively high engine speed without energy waste, in the ignition circuit over practically the whole range of normal engine running.

By the switching over of the emitter-collector path of the driver transistor 41 into the conducting condition, the circuit branch through the diode 40, the resistor 39 and the diode 38 to the control circuit point 14 is also effective, so that in the switched-on condition of the threshold switch 15 the common connection point of the resistor components 36 and 37 comes at least very close to the potential of the control circuit point 14 and the influence exerted by the integrator 31 on the threshold switch 15 is blocked. In this manner, it is provided in a very simple way that the switch-off threshold U3 of the threshold switch 15 will have a stabilized position, so long as the switch-on threshold U2 is shifted from its quiescent position towards the peak value U1 of the positive halfwave W1. The ignition timing instant is thus not subject to any disturbance from the effect of the integrator 31. At higher speeds this stabilization is no longer necessary, because the portion of the voltage timing wave following the peak value U1 then falls off relatively steeply.

Since in the ignition system of the present invention the regulation of the period of current flow in the primary winding 5 is dependent upon the rise of this current to a predetermined value, namely the control value J1, a constant amount of ignition energy storage per cycle is obtained even with variation in the voltage of the direct current source.

Although the invention has been described with reference to a particular preferred embodiment, variations and modifications may be made within the inventive concept. For instance, the timing control wave may be produced by any kind of a tachogenerator and made available to the control circuit through a pulse shaping circuit.

We claim:

1. In an ignition system for an internal combustion engine, having a spark coil (6) of which a primary winding (5) is connected in series with an electronic interruptor switch (7) and with a source (1) of direct current of which one terminal is grounded to the engine structure, and of which coil a secondary winding (9) is connected to supply ignition potential to one or more spark plugs upon successive sudden interruptions of current in the primary winding (5) by the interruptor switch (7), and having an engine-driven generator (26) of voltage waves for enabling said electronic switch (7) to be operated in step with the operation of the engine, a circuit for energization of said primary winding and control of said interruptor switch, comprising in combination:

a voltage-sensitive electronic switch (15) for providing voltage steps for respectively switching on and off said electronic interruptor switch (7), said voltage-sensitive switch (15) having its input circuit connected to said wave voltage generator (26) and to said direct current source (1) in such a way as to permit its switching threshold voltages to be varied from their respective quiescent-state values; and means for producing a regulating voltage including an integrator connected so that its direction of output voltage change is determined by the amount of current through said interruptor switch (7) and so as to change its output voltage progressively in one direction from the moment of a switch-on operation of said voltage-sensitive switch (15) until the current through said interruptor switch (7) reaches a predetermined value and thereafter to change its output voltage progressively in the other direction until the moment of a switch-off operation of said voltage-sensitive switch (15), said predetermined value of current through said interruptor switch (7) being less than that value of current in said primary winding (5) of said spark coil (6) which constitutes a sufficient storage of ignition energy in said spark coil (6) for generation of a fully effective ignition spark;

the output voltage of said integrator being applied to said voltage-sensitive switch to vary the switch-on threshold of said voltage-sensitive switch and said regulating voltage-producing means being also connected in circuit with said voltage-sensitive switch (15) so as to prevent the latter's switch-off threshold from being deviated by the operation of said integrator, whereby while the duration of current flow through said interruptor switch (7) tends to be excessive, the switch-on voltage threshold of said voltage-sensitive switch is shifted within the peak-to-peak output voltage range of said generator (26) in the direction (A) producing an earlier start of current through said interruptor switch (7) and while the duration of current flow through said interruptor switch (7) tends to be insufficient, the switch-on threshold of said voltage-sensitive switch (15) is shifted in the opposite direction (B) corresponding to a later start of current in said interruptor switch (7).

2. An energization and control circuit in an engine ignition system as defined in claim 1, in which the output voltage of said integrator (31) is arranged to be held substantially constant from the time of a switch-off operation of said voltage-sensitive switch (15) until the time of the next switch-on operation of said voltage-sensitive switch (15).

3. An energization and control circuit in an engine ignition system as defined in claim 1 in which means connected to said direct current source (1) are provided for applying a reference voltage to said generator (26) and to said voltage-sensitive switch (15), said reference voltage applying means including a voltage divider having a tap (14) of which the potential is intermediate between the potentials of the terminals of said direct current source (1), said tap being connected to a terminal of said generator and to a terminal of an input network of said voltage-sensitive switch.

4. An energization and control circuit in an engine ignition system as defined in claim 3 in which the potential of said tap (14) of said voltage divider is at least approximately equal to half of the output voltage of said direct current source (1).

5. An energization and control circuit in an engine ignition system as defined in claim 1 in which a clamping circuit is provided for preventing the shift of the switch-off threshold of said voltage-sensitive switch (15) while the switch-on threshold of said voltage-sensitive switch is deviated from its quiescent value in the direction (A) towards the generator output peak voltage of the polarity of the ungrounded terminal of said direct current source (1).

6. An energization and control circuit in an engine ignition system as defined in claim 1 in which means are provided for limiting the rate of current flow through said interruptor switch (7) to a value higher than said predetermined value, whereby excessive flow of current during low speed operation of the engine is prevented.

7. An energization and control circuit in an engine ignition system as defined in claim 3 in which said voltage-sensitive switch is constituted by an operational amplifier (16) having an output connection (19), an inverting input connection (17), and a noninverting input connection (18), and having a positive feedback resistor (20) connected between said output and said noninverting input, having said noninverting input (18)

connected to said voltage divider tap (14) and having its inverting input (17) connected so as to receive an output signal from said generator (26) and in which, further, said regulating voltage producing means comprises an integrator (31) responsive to the amount of current through said interruptor switch (7) and having an output connected so as to provide an input to said inverting input (17) of said operational amplifier (16), and in which, further, a driver transistor (14) is provided having its control electrode connected so as to receive an input from the output connection (19) of said operational amplifier (16) for placing said electronic interruptor switch (7) in the conducting condition when said voltage-sensitive switch (15) is in the switched-on condition.

8. An energization and control circuit in an engine ignition system as defined in claim 2 in which at least one constant current generator (45,46) is provided for said integrator (31) and connected therewith so as to produce both said first and said second changes of integrator output voltage by means of a constant flow of current.

9. An energization and control circuit in an engine ignition system as defined in claim 6 in which said first change (ΔU5) of integrated output voltage (U6) is an increase of output voltage and said second change (ΔU7) of integrator output voltage (U8) is a decrease of integrator output voltage.

10. An energization and control circuit in an engine ignition system as defined in claim 7 in which two constant current sources are provided for said integrator respectively comprising a first control transistor (45) having a conductivity stabilized emitter-collector path connected to a positive voltage supply line (3) and a second control transistor (46) having a conductivity stabilized emitter-collector path connected to a negative voltage supply line (4), and in which said emitter-collector paths of said respective first and second control transistors have a common connection for supplying constant flow of current for operation of said integrator (31).

11. An energization and control circuit for an engine ignition system as defined in claim 10, in which said regulating voltage producing means comprises a monitoring transistor (59) in a circuit causing it to be responsive to the amount of current in said primary winding (5) and having an output circuit arranged to put the emitter-collector path of said first control transistor (45) into the nonconducting condition and, at the same time, to put the emitter-collector path of said second control transistor (46) in the conducting condition as soon as the current in said primary winding (5) reaches a predetermined value (J1) selected for control purposes.

12. An energization and control circuit in an engine ignition system as defined in claim 1, in which said regulating voltage producing means includes a monitoring resistor (8) connected in series with said primary winding (5) and said interruptor switch (7) on the other side of said interruptor switch from said primary winding.

13. An energization and control circuit in an engine ignition system as defined in claim 12, in which the switching path of said electronic interruptor switch (7) is constituted by the emitter-collector path of a transistor (7').

14. An energization and control circuit in an engine ignition system as defined in claim 12, in which there is provided in shunt with said monitoring resistor (8) a circuit including the base-emitter path of a monitoring transistor (59).

15. An energization and control circuit in an engine ignition system as defined in claim 13, in which there are provided a monitoring transistor (59) and a supplementary transistor (61) having their respective base-emitter paths in respective circuits which are in shunt with said monitoring resistor (8), said supplementary transistor (61), having its emitter-collector path connected in a circuit for limiting the base-emitter current of said interruptor switch transistor (7') the emitter-collector conductivity of said interruptor switch transistor (7') when the current in said primary winding (5) has reached a desired maximum value (J2).

16. An energization and control circuit in an engine ignition system as defined in claim 15, in which said generator (26) provides an output voltage wave such that after the current in said primary winding (5) reaches said desired maximum value, said current is caused to continue to flow at the same rate for a brief further period (t2−t3).

17. An energization and control circuit in an engine ignition system as defined in claim 7, in which said generator (26) provides an output voltage wave signal that comprises at least the positive halfwave (W1) of one alternating output voltage period of said generator (26) with reference to said reference voltage.

18. An energization and control circuit in an engine ignition system as defined in claim 17, in which the output of said generator (26) is such that during starting of said engine said voltage sensitive switch (15) is both switched on and off by said positive halfwave (W1), and, further, in which after further speed increase of said engine, both said switch-on threshold (U2) and said switch-off threshold (U3) of said voltage sensitive switch (15) are shifted until at least the neighborhood of the negative peak value (U4) of the negative halfwave (W2) of the said alternating current period of the output wave of said generator (26).

19. An energization and control circuit in an engine ignition system as defined in claim 7, in which the connection between said integrator (31) to the inverting input (17) of said operational amplifier (16) comprises two parallel branches (29,30), in the first of which (29) is a series connection of a resistor (32) and a first diode (33) having its cathode connected with said integrator (31) and a second branch (30) comprising a series connection of a resistance (34) and a second diode (35) having its anode connected with said integrator (31).

20. An energization and control circuit in an engine ignition system as defined in claim 19, in which said first branch (29) of said connection between said integrator (31) and said inverting input (17) of said voltage sensitive switch (15) has its influence blocked during the switched-on condition of said voltage sensitive switch (15).

21. An energization and control circuit in an engine ignition system as defined in claim 20, in which said resistor (32) in said first branch (29) of the connection between said integrator (31) and said inverting input (17) of said operational amplifier (16) is composed of two resistor components (36,37) at the common connection of which is provided a third diode (38) causing said common connection to have a potential approximating said reference potential during the switched-on condition of said voltage sensitive switch (15).

22. An energization and control circuit in an engine ignition system as defined in claim 3, in which said integrator (31) is constituted by a capacitor (44) having one terminal connected to said tap (14) of said voltage divider and its other terminal connected through two parallel branch circuits (29,30) to an input of said voltage sensitive switch.

23. An energization and control circuit in an engine ignition system as defined in claim 1, in which said quiescent-state values of said switching threshold voltages differ at most only slightly from a reference voltage applied to said generator (26) and to said voltage-sensitive switch (15) by means of said direct current source (1), said quiescent-stage values lying between said reference voltage and the potential of the ungrounded terminal of said direct current source (1).

24. In an ignition system for an internal combustion engine of the kind having a control signal generator, a threshold switch connected so as to be responsive thereto and an electronic interruptor switch arranged to conduct current during the switched-on condition of said threshold switch and having also an ignition transformer having, in addition to a secondary winding, a primary winding connected in series with the switch path of said electronic interruptor switch, said control signal generator being constructed so that the control signal provided thereby rises up to its peak value over a first period of time covering an ignition timing range for said engine, whereby the switch-on moment of said threshold switch occurs during said time period and the switch-off moment thereof during a second time period following said first time period, said system further including electric circuit means for generating a regulating voltage in response to, and dependent upon, the value of current flowing through said primary winding and for applying said regulating voltage to produce a relative shift in a direction dependent on the duration of current in said primary winding, of the switch-on moment of said threshold switch relative to the phase of said control signal, the improvement which consists in that:

said electric circuit means includes an integrator (31) connected so that its direction of output voltage change is determined by the amount of current flowing through said interruptor switch and so is so constituted that in response to excessively long duration of current flow in said primary winding (5) resulting from low speed of said engine, a regulating voltage is provided that produces a shift of the switch-on voltage (U2) of said threshold switch (15) in the direction (A) towards the peak value of said control signal and in response to insufficient duration of current flow in said primary winding (5) resulting from high engine speed, a regulating voltage is provided that produces a shift of said switch-on voltage (U2) of said threshold switch (15) in the opposite direction (B);

said integrator (31) is connected as to change the direction of change of its output voltage at an empirical control value (J1) of primary current which is less than an ultimate value (J2) thereof that is sufficient for a fully effective spark in said engine, whereby said electric circuit means is made capable of substantially preventing, by the regulation action of said electric circuit means, any further increase of current beyond said ultimate value.

25. An improvement in an ignition system as defined in claim 24, in which said integrator (31) is arranged to hold its output voltage substantially constant from the time of a switch off operation of said threshold switch (15) until the time of the next switch-on operation of said threshold switch, said integrator (31) being further arranged to change its output voltage in one direction from the moment of a switch-on operation of said threshold switch (15) until the current through said interruptor switch (7) reaches said empirical value of current and thereafter to change its output voltage in the other direction until the moment of a switch-off operation of said threshold switch.

26. An improvement in an ignition system as defined in claim 24 in which said electric circuit means includes a clamping circuit for preventing the shift of the switch-off voltage of said threshold switch (15) while the switch-on voltage thereof is deviated from its quiescent value in the direction (A) towards the peak voltage of said control signal.

27. An improvement in an ignition system as defined in claim 25 in which means are provided for limiting the rate of current flow through said electronic interruptor switch (7) at a value higher than said empirical control value of current.

28. An improvement in an ignition system as defined in claim 25 in which at least one constant current generator (45,46) is provided for said integrator (31) and connected therewith so as to produce both said first and said second changes of integrator output voltage by means of a constant flow of current.

* * * * *